US011236566B2

(12) United States Patent
Toge et al.

(10) Patent No.: US 11,236,566 B2
(45) Date of Patent: Feb. 1, 2022

(54) DOWNHOLE DEBRIS COLLECTING DEVICE WITH A FILTER

(71) Applicant: Altus Intervention (Technologies) AS, Stavanger (NO)

(72) Inventors: Gunn Elin Toge, Stavanger (NO); Kristian Andersen, Stavanger (NO)

(73) Assignee: Altus Intervention (Technologies) AS, Stavanger (NO)

( * ) Notice: Subject to any disclaimer, the term of this patent is extended or adjusted under 35 U.S.C. 154(b) by 8 days.

(21) Appl. No.: 16/341,955

(22) PCT Filed: Nov. 9, 2017

(86) PCT No.: PCT/NO2017/050288

§ 371 (c)(1),
(2) Date: Apr. 15, 2019

(87) PCT Pub. No.: WO2018/088910

PCT Pub. Date: May 17, 2018

(65) Prior Publication Data

US 2019/0257165 A1 Aug. 22, 2019

(30) Foreign Application Priority Data

Nov. 11, 2016 (NO) ..... 20161789

(51) Int. Cl.

| | |
|---|---|
| ***E21B 27/00*** | (2006.01) |
| ***E21B 37/00*** | (2006.01) |
| ***E21B 10/42*** | (2006.01) |

(52) U.S. Cl.
CPC ..... *E21B 27/005* (2013.01); *E21B 10/42* (2013.01); *E21B 37/00* (2013.01)

(58) Field of Classification Search
CPC ..... E21B 27/005; E21B 27/00; E21B 31/08
See application file for complete search history.

(56) References Cited

U.S. PATENT DOCUMENTS 2,169,922 A * 8/1939 Notley ..... E21B 27/005 166/99
2,984,310 A * 5/1961 Meier ..... E21B 23/00 175/98
3,123,157 A * 3/1964 Graham ..... E21B 49/02 175/58

(Continued)

FOREIGN PATENT DOCUMENTS

WO 03036020 A1 5/2003
WO 2008058540 A1 5/2008
WO 2008104177 A1 9/2008

*Primary Examiner* — Kipp C Wallace
(74) *Attorney, Agent, or Firm* — Gable Gotwals

(57) ABSTRACT

A collecting device for displacement in a tubing. The collecting device is extended in shape with a longitudinal axis and forms a leading portion with an entrance and an end portion. The device includes a wall extending from the leading portion to the end portion, a collecting chamber formed inside a portion of the wall, a filter positioned with the collecting chamber, a motor, a pump, and an outlet at the end portion, where the filter stocking provided with an open first end portion and a closed second end portion, and the open first end portion faces the leading portion, a and the filter stocking forms a receptacle. A method for emptying the collecting device is described.

18 Claims, 6 Drawing Sheets

(56) References Cited

U.S. PATENT DOCUMENTS

| | | | | | |
|---|---|---|---|---|---|
| 3,572,431 | A * | 3/1971 | Hammon | E21B 27/00 166/99 |
| 3,910,360 | A * | 10/1975 | Sundstrom | E21B 21/07 175/38 |
| 4,603,739 | A * | 8/1986 | Krugh | E21B 27/00 166/170 |
| 6,158,512 | A | 12/2000 | Unsgaard | |
| 6,276,452 | B1 * | 8/2001 | Davis | E21B 21/002 166/298 |
| 10,119,383 | B2 * | 11/2018 | Mazzanti | E21B 43/38 |
| 2011/0049025 | A1 * | 3/2011 | Davis | B01D 35/02 210/109 |
| 2014/0014358 | A1 * | 1/2014 | Leitch | E21B 43/38 166/369 |
| 2015/0218901 | A1 * | 8/2015 | Juhlin | E21B 43/084 166/105.1 |
| 2017/0009545 | A1 * | 1/2017 | Haugland | E21B 27/00 |
| 2017/0107798 | A1 * | 4/2017 | Gourmelon | E21B 43/38 |
| 2018/0015395 | A1 * | 1/2018 | Prost | B01D 29/6484 |
| 2018/0073317 | A1 * | 3/2018 | Haugland | E21B 43/08 |
| 2018/0073334 | A1 * | 3/2018 | Winters | E21B 43/086 |
| 2018/0328146 | A1 * | 11/2018 | Kartha | E21B 37/00 |

* cited by examiner

DOWNHOLE DEBRIS COLLECTING DEVICE WITH A FILTER

CROSS-REFERENCE TO RELATED APPLICATIONS

This United States application is the National Phase of PCT Application No. PCT/NO2017/050288 filed 9 Nov. 2017, which claims priority to Norwegian Patent Application No. 20161789 filed 11 Nov. 2016, each of which is incorporated herein by reference.

The present invention relates to a downhole collecting device for use in a petroleum well. The collecting device is used to collect and remove settled material, also termed debris, from a tube in the well. In particular, the collecting device collects debris from a tube filled with a liquid, such as well liquid. More specifically, the invention relates to a collecting device with an internal filter in a collecting chamber. The filter comprises a filter stocking, and the filter's opening is facing a leading end of the collecting device. The filter stocking forms a receptacle for the debris. The filter stocking may be a disposable filter stocking. Emptying of at least a part of the collecting chamber for collected debris is performed by removing the filter stocking from the collecting chamber.

Preferably the filter stocking is removed by displacement through the collecting device's leading end. The invention relates in addition to a method for use of the collecting device.

In the petroleum industry it is well known that production wells may produce sand together with oil and gas. There are several reasons for sand production, among other things that the petroleum reservoir is less consolidated than assumed or that the production rate is too high. Sand production causes several problems. Sand grains in a fluid act as an abrasive and may erode pipes and valves. Formation damage is another problem associated with sand producing wells. In general, a sand producing well may reduce the production rate.

To overcome or at least to reduce problems associated with sand production, several methods are known. One method is use of screens or slotted liners and screens. One type of screen is known as wire-wrapped screen. A wire-wrapped screen consists of keystone-shaped, corrosion resistant wire wrapped helically into a circular shape. The wire is welded to several axial rods arranged around the inside circumference of the screen. The wire-wrapped screen may be welded to the surface of a slotted liner, forming a pipe-base wire-wrapped oil well screen. It is also known to use two concentric wire-wrapped screens one on the outside of the other. The annulus between the wire-wrapped screens may be packed with gravel-packed sand. This is termed dual-wrapped pre-packed well screen.

The keystone-shaped wire is circular wrapped with the widest portion facing outwards of the screen and the narrowest portion facing inwards. Thereby a tapered slot is formed between two consecutive wires. The smallest axial distance between two consecutive wires is in the industry expressed in units of 0.001 in (0.0254 mm). The unit is referred to as the gauge of the screen. A 6-gauge screen will have a space between the wires of 0.006 in (0.15 mm).

Another type of screen is a premium screen. A premium screen uses a woven metal cloth.

In the following description the size ranges defined in the Udden-Wentworth scale is used. Clay particles are less than 0.004 mm (0.00015 in) in size and silt particles are between 0.004 mm and 0.0625 mm (0.0015-0.0025 in) in size. In comparison very fine sand particles are between 0.0625 and 0.125 mm (0.0025-0.0049 in) in size and fine sand particles are between 0.125 and 0.25 mm (0.0049-0.010 in) in size. According to ISO 14688-1 clay particles are less than 0.002 mm in size.

It is common to classify petroleum wells into:

Conventional wells where maximum angular deviation away from the vertical direction is about 65°

Extended Reach Drilled (ERD) where the angular deviation away from the vertical direction is larger than 65°

Horizontal wells where portion of the wells demonstrate an angular deviation about 90° away from the vertical direction.

Some wells are not provided with sand screens. In several sand producing wells, sand is efficiently kept out of the production tubing by screens. However, screens will not prevent migration of fine material as silt and clay from the reservoir and into the production tubing. Silt and clay will follow the petroleum stream, or will settle out. In deviated, and especially in highly deviated and horizontal wells, such settled material will build up and choke or at least partially choke the production tubing. Even in smaller amounts such debris or settled material may obstruct maintenance work such as wire line operations. Thereby it is not possible to place the intervention tools in the desired position.

The deposit will due to the gravitational force build up from the "6 o'clock" position inside the production tubing and have a lengthy shape in deviating and horizontal wells.

Use of coiled tubing is a known method to remove fine material or deposit that have settled in the production tubing. Once installed coiled tubing is a method with high capacity, however, it is a time consuming and an expensive task to mobilize the coiled tubing equipment. After completion of the task it is expensive and time consuming to demobilize the equipment as well.

Wire line tractors are known in the petroleum industry for their ability to perform tasks in deviating and horizontal wells due to their built-in propulsion mechanism. Wire line tractors are provided with interchangeable well intervention equipment. Patent document WO 03/036020 discloses a collecting device to be pushed in a deviating or horizontal production pipe by a wire line tractor. Settled sand is loosened by a front scraper and transported into the collecting device by a feed screw. When filled, the collecting device is returned to the surface for emptying.

In contrast to sand, fine particular debris such as clay and silt will not settle rapidly after being whirled up. Known collecting devices will not effectively remove clay and silt from oil producing wells, as a major part of the collected material will be liquid. After being whirled up, silt will settle slowly while clay will remain suspended for a considerable time. Suspended clay is difficult to separate out by conventional filtering techniques.

The collecting device disclosed by WO 03/036020 is an example of a device where the material is transported into a collecting chamber by an auger screw. Patent document U.S. Pat. No. 6,158,512 discloses an example of a device where a pump is located at a first end portion of a collection chamber and the collection chamber has an inlet at a second end portion opposite of the first end portion. The collection chamber is thus on the suction side of the pump. To protect the pump, a filter is positioned between the collection chamber and the inlet of the pump. Patent document WO 2008/104177 discloses the same functionality.

The use of a filter as described in U.S. Pat. No. 6,158,512 has several drawbacks. The material to be collected may contain small particles, such as sand and silt. The mesh size of the filter must then be fine to separate particles from the fluid and/or to avoid that particles are drawn into the pump. If the filter area is small, the filter will quickly be covered by material and the material forms a filter cake and the fluid flow is restricted.

This will limit the collecting capacity of the system. This problem is partly overcome by using a filter with a three-dimensional, hollow cone- or pyramid shaped-body as disclosed in U.S. Pat. No. 6,158,512. The filter itself thus forms a mouth portion that is oriented towards the inlet/suction side of the pump.

The particle size may change during a cleaning operation. Fine particles may form the top layer while more coarse particles may be more abundant at the bottom of a sediment collection. If the mesh size of the filter is adapted to the coarse material, smaller particles will not be collected and some of the fine material will pass through and may harm the pump. If the mesh size of the filter is adapted to the finest material, a filter cake may build and make the operation less effective. If the mesh size is too large, even coarse particles may enter the pump and cause abrasion and damage to the pump.

A collecting device as disclosed in U.S. Pat. No. 6,158,512 may be efficient, but it is sensitive. Small changes in the particle size may change the operation from being highly efficient to poor performing.

The settled material may comprise silt, sand and more coarse material as gravel or a mixture of silt, sand and possible gravel. The settled material may in addition contain clay. In addition, the settled material may comprise metal chips/swarfs and bigger sized objects.

The invention has for its object to remedy or to reduce at least one of the drawbacks of the prior art, or at least provide a useful alternative to prior art.

The object is achieved through features, which are specified in the description below and in the claims that follow.

The invention relates to a filter stocking that provides a large surface area for filtering a debris collected from a well tubing. The well tubing may be filled with a liquid and the debris may be suspended in the well liquid prior to entering the filter stocking. The filter stocking is open in one end portion and closed in the opposite end portion. The filter stocking may be closed by a strap. As an alternative, the filter stocking may be closed by a self-locking strip. In a further embodiment the filter stocking may be closed by a seam. In a still further embodiment the filter stocking may be closed by a weld.

The filter stocking may be a disposable filter stocking. The filter stocking may be disposed together with a collected material within the filter stocking. The filter stocking may be provided as a reel, and a suitable length is cut from the reel. The suitable length is closed in one end portion as described above.

The filter stocking is fastened to a collecting device in a manner that distributes the debris to be collected within the filter stocking, and such that debris within the filter stocking is not by purpose or accident emptied from the filter stocking's hollow through the open end. This may be achieved by a check valve positioned at the entrance of fluid flow into the filter stocking or at the open end of the filter stocking. The filter stocking may not be vibrated, and the collecting device may not be provided with a vibrator for active vibrating of the filter stocking.

Filters used in known collecting devices are used to protect pumps and to retain material that are collected in designed receptacles. According to the present invention, the filter itself forms the receptacle for the collected material.

In a first aspect the invention relates more particularly to an extended collecting device for displacement in a tubing, the collecting device having a longitudinal axis, the collecting device forms a leading portion with an entrance and an end portion; the collecting device comprises:

a wall extending from the leading portion to the end portion;
a collecting chamber formed inside the wall;
a filter positioned within the collecting chamber;
a motor;
a pump; and
an outlet at the end portion, where the filter comprises an extended filter stocking provided with an open first end portion and a closed second end portion, and the open first end portion faces the collecting device's leading portion, and the filter stocking forms a receptacle for a collected material.

The collecting device may comprise a nose at the leading portion, and the nose is provided with a through bore which forms the entrance. The filter stocking's open first end portion may be connected to the nose by a fastener. The nose may be detachable from the collecting device. The entrance may be axially oriented.

The motor and the pump may be positioned at the end portion. In an alternative embodiment the motor and the pump may be positioned at the leading portion. The pump is designed for pumping a liquid.

The pump may be positioned up streams of the filter stocking's open end portion in a flow path from the leading portion through the collecting chamber and out through the outlet. A detachable adapter may be positioned between the pump and the filter stocking and the filter stocking's open end portion may be connected to the adapter by a fastener.

A conduit may extend within the collecting chamber from the filter stocking's open end portion such that the conduit forms a part of a flow path from the leading portion through the collecting chamber and out through the outlet. The conduit may at a free end be provided with a passive check valve. The passive check valve may comprise a duck bill valve. The conduit may at a free end be provided with a deflector between the free end and the collecting device's second end portion.

In a second aspect the invention relates more particularly to a method for emptying a collecting device as described above, wherein said method comprises the steps of:

a) retrieve the collecting device to a surface;
b) open the collecting device; and
c) displace the filter stocking axially towards the collecting device's leading portion.

The method may further comprise the step of:

d1) detach the filter stocking from a nose at the leading portion

As an alternative the method may further comprise the step of:

d2) open the collecting device by splitting the collecting device at an adapter;
d3) de-assemble the adapter from the collecting device; and
d4) detach the filter stocking from the adapter.

The method may further comprise the step of:

e) close the filter stocking's first end portion.

The method may further comprise the step of:

f) displace the filter stocking axially to fully release the filter stocking from the collecting device.

After the filter stocking is removed from the collecting device, a new, empty filter stocking is positioned within the collecting chamber. The collecting device is thereafter assembled and ready for a new trip within the well.

The use of a filter stocking with a closed end portion facing the collection device's outlet and with a mouth portion facing the collection device's inlet, provides a large available filter area. Material will start filling at the filter stocking's closed end portion. As filling proceeds, material will accumulate in the filter stocking from the filter stocking's closed end and towards the mouth portion. Thereby, when the filter stocking's surface is blocked with material, the collection chamber is full with collected material. This ensure an efficient operation.

A blocked filter stocking or an almost blocked filter stocking may trigger a fill signal by reading the power consumption of the pump. The power consumption of a centrifugal pump will drop rapidly when the filter stocking's surface is blocked with material. The power consumption of a positive displacement pump, such as a monopump, will increase rapidly when the filter stocking's surface is blocked with material.

In the following is described examples of preferred embodiments illustrated in the accompanying drawings, wherein.

Figure 1:
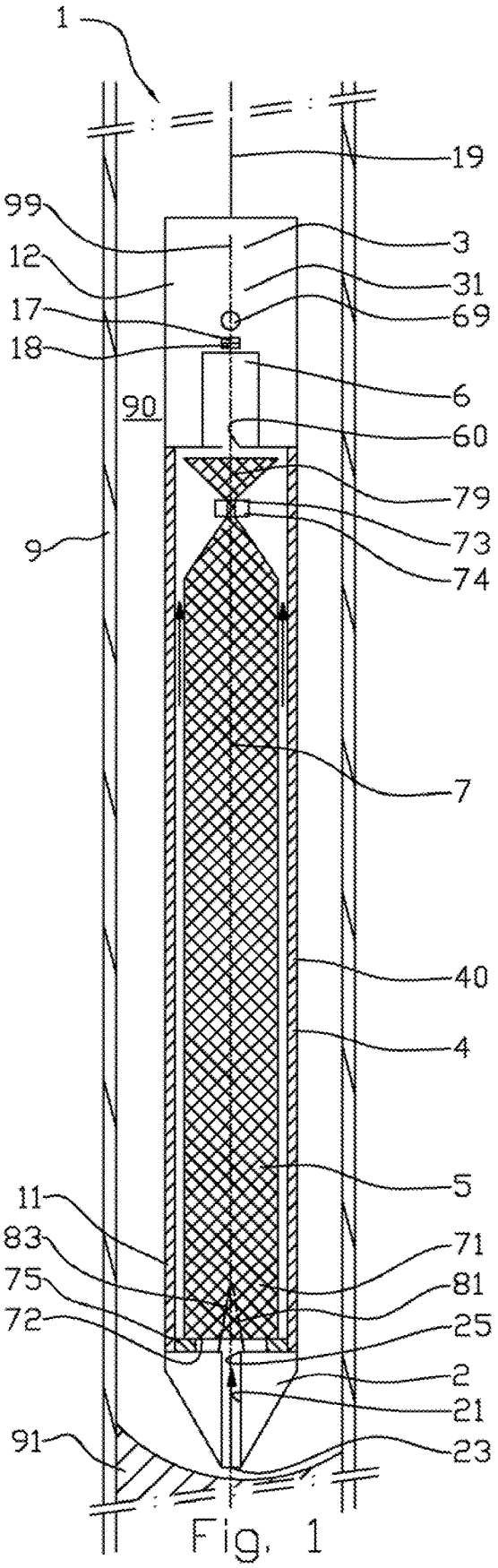
FIG. 1 shows a schematic partly cross section of a collecting device with a filter stocking according to the invention in a production tubing, where the collecting device comprises an open leading portion and a pump at an opposite end portion.

In the figures, the reference numeral 1 indicates a collecting device in accordance with the invention. The collecting device 1 is shown positioned in a production tubing 9 within a casing or a wellbore (not shown). The production tubing 9 is shown as a vertical tubing, but the collection device 1 is designed to work movably in production tubings 9 having an inclination between vertical and horizontal direction. In an inside portion of the production tubing 9 there is a deposit of settled material 91. The settled material 91 may comprise silt, sand and more coarse material as gravel or a mixture of silt, sand and possible gravel. The settled material 91 may in addition contain clay, swarf and junk.

The collecting device 1 forms a leading portion 11 and an end portion 12. The collecting device 1 comprises a nose 2 at the leading portion 11. A wall 4 extends from the nose 2 to the end portion 12. A collecting chamber 5 is formed inside the wall 4. An inlet 60 at the end portion 12 is in fluid communication with the collecting chamber 5. An outlet 69 at the end portion 12 is in fluid communication with the outside 90 of the collecting device 1. In one embodiment a drive unit 3 is positioned at the end portion 12. The drive unit 3 houses a motor 31 of a type known per se and the internal static pressure of the drive unit 3 is kept above ambient pressure to avoid gas ingress as known in the art. The drive unit 3 further houses a pump 6. The pump 6 is powered by the motor 31 in the drive unit 3, and the pump 6 is of a type known per se. By example the pump may be a centrifugal pump, a positive displacement pump such as a monopump, or an ejector pump. The pump 6 is in one embodiment on the pump's 6 suction side in fluid communication with the inlet 60 and the pump 6 is on the pump's 6 pressure side in fluid communication with the outlet 69 as shown in FIGS. 1, 2, 5 and 6.

Figure 6:
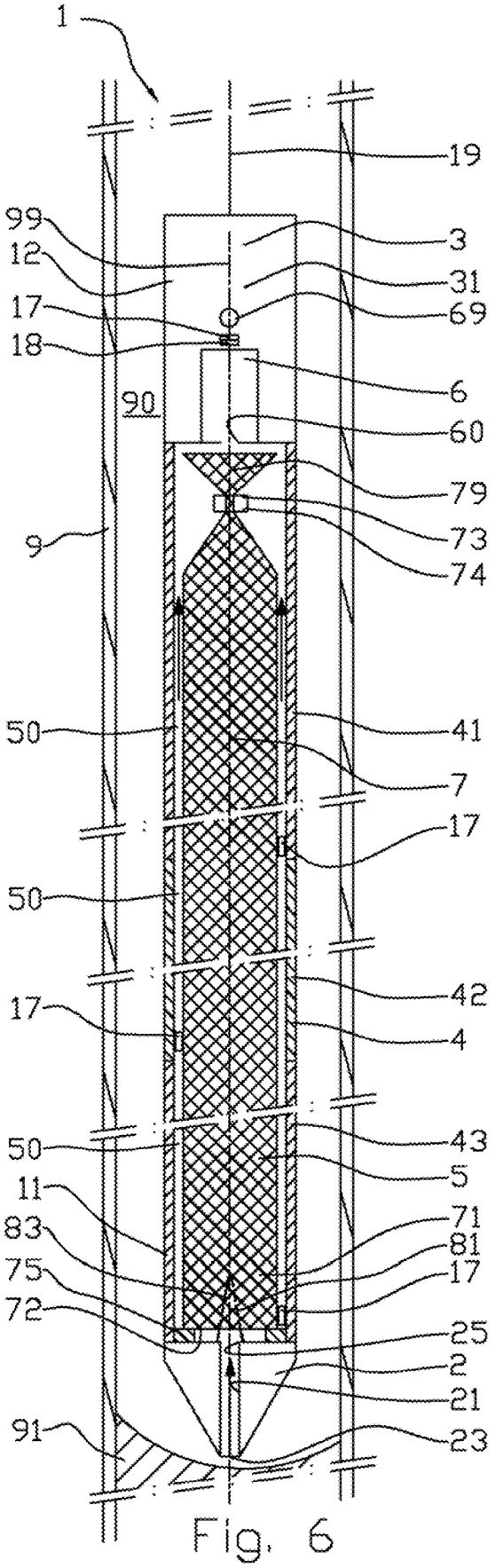
FIG. 6 shows the same as FIG. 1, where the collection chamber is shown made up of several sections.

The collecting chamber 5 may be formed by a tubular section 40. The tubular section 40 may comprise two or more tubular sections 41, 42, 43 as shown in FIG. 6 where three sections are shown. The tubular sections 41, 42, 43 may in one embodiment be joined by threaded ends (not shown) as known in the art, e.g. by a threaded winder (not shown). In a second embodiment the tubular sections 41, 42, 43 may be joined by a flange connection (not shown). The collecting chamber 5 is continuous through the tubular section 40.

At the end portion 12 the collecting device 1 is provided with a cable 19. The cable 19 is an electric cable/wire line cable of a type known per se. The electric cable 19 provides electrical energy to the motor 31 in the drive unit 3, and the collecting device 1 may be pulled out of the production tubing by the cable 19. In an alternative embodiment the collecting device 1 is pushed downwards or pulled upwards by a wire line tractor (not shown) in a way well known to the skilled person. The wire line tractor may also provide energy for the motor 31.

The collecting device 1 is extended in shape. The collecting device 1 is slim with a relative small diameter compared to the length, and the collecting device 1 has a longitudinal axis 99.

A filter stocking 7 is positioned within the collecting chamber 5. The filter stocking 7 forms a first end portion 71 and an opposite second end portion 79. The first end portion 71 is open and forms a mouth portion 72. The second end portion 79 which faces the end portion 12, is closed and is positioned at the collecting device's 1 end portion 12.

The filter stocking 7 is in one embodiment closed in its second end portion 79 by a strap 73, a self-locking strip 74 or a similar closing device suitable for closing a filter stocking 7 as shown in FIGS. 1-4 and 6-7.

Figure 3:
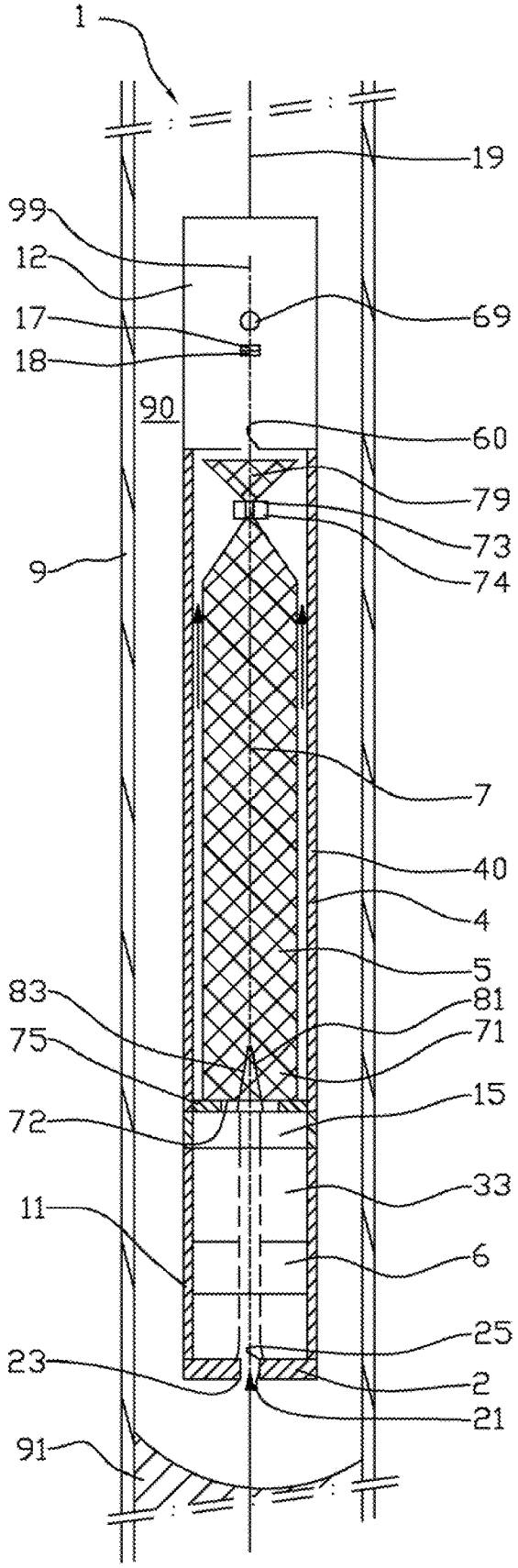
FIG. 3 shows in the same scale as FIG. 1 a collecting device according to the invention with a pump at the leading portion.
Figure 4:
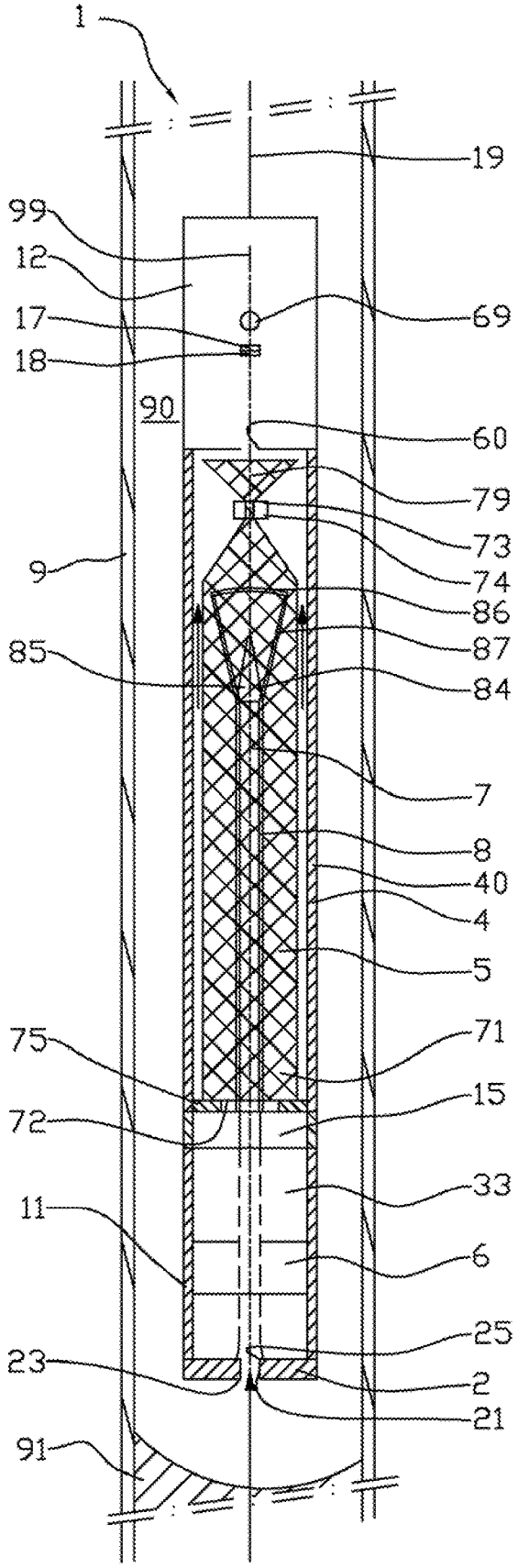
FIG. 4 shows the same as FIG. 3 in another embodiment.
Figure 7:
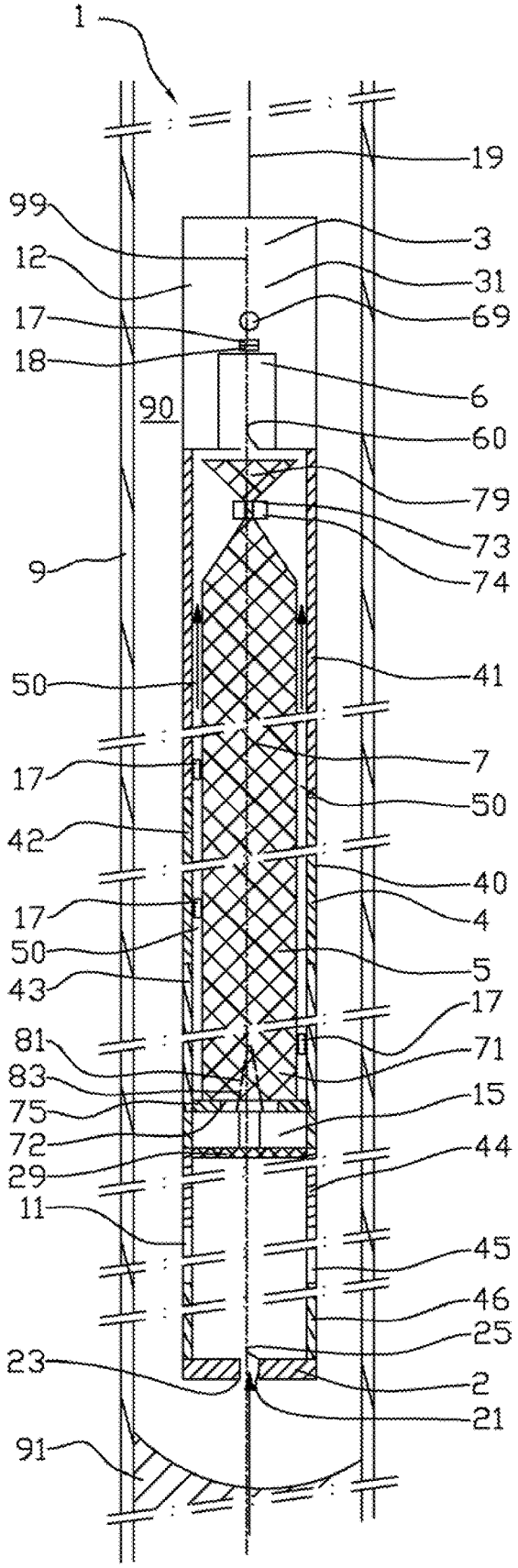
FIG. 7 shows the same as FIG. 4, where the collection chamber is shown made up of several sections and the filter stocking is located with some of the sections.

A fastener 75 is adapted to keep the first end portion 71 of the filter stocking 7 open. The fastener 75 may surround the filter stocking 7 in its full circumference. The fastener 75 may be a snap ring. The fastener 75 is in alternative embodiments fixed to an adaptor 15 as shown in FIGS. 3, 4 and 7.

The filter stocking 7 may in one embodiment be made of threads, wire or filaments of a synthetic material such as a synthetic polymer material. The filter stocking 7 may in an alternative embodiment be made of threads, wire or filaments of a metal. The metal may be steel. The mesh size of the filter stocking 7 is chosen according to known or estimated particle size of the settled material 91. The mesh size is small enough to withhold fines in the settled material 91.

Figure 2:
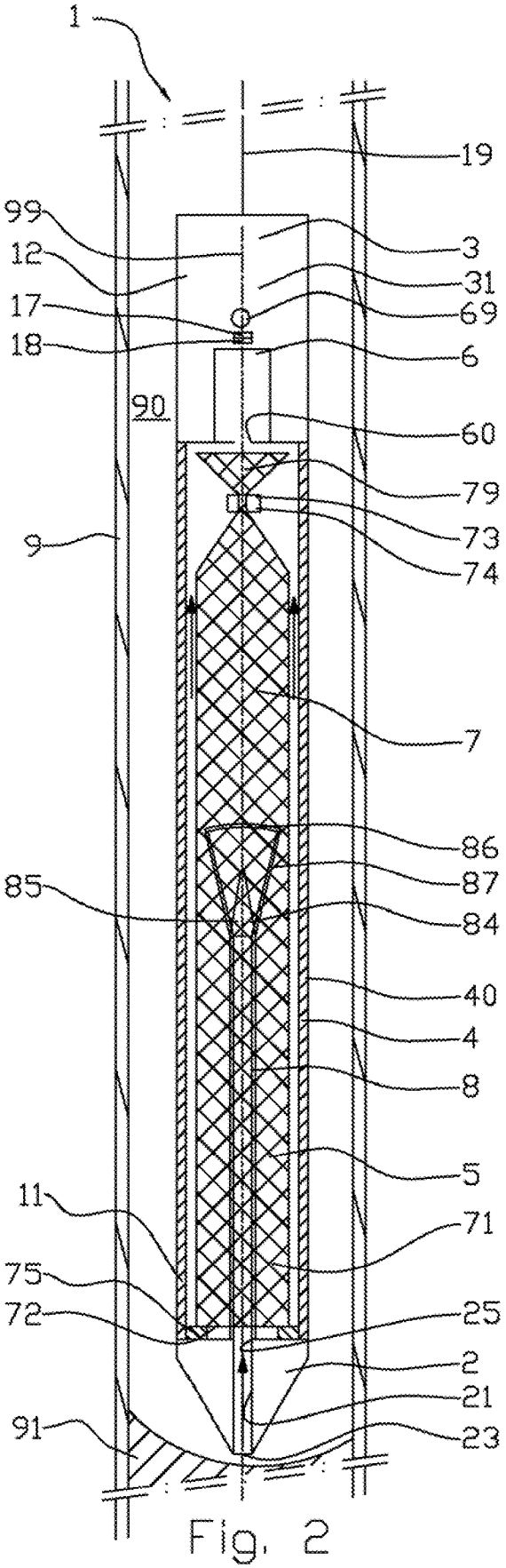
FIG. 2 shows the same as FIG. 1 according to a second embodiment.

The nose 2 may be of different shapes adapted to the task to be performed by the collecting device 1. A possible first shape is schematically shown in FIGS. 1, 2 and 6, a possible second shape is shown in FIGS. 3, 4 and 7. The nose 2 is provided with at least one through bore 21 which forms an external inlet 23 and an internal outlet 25 in the nose 2.

Figure 5:
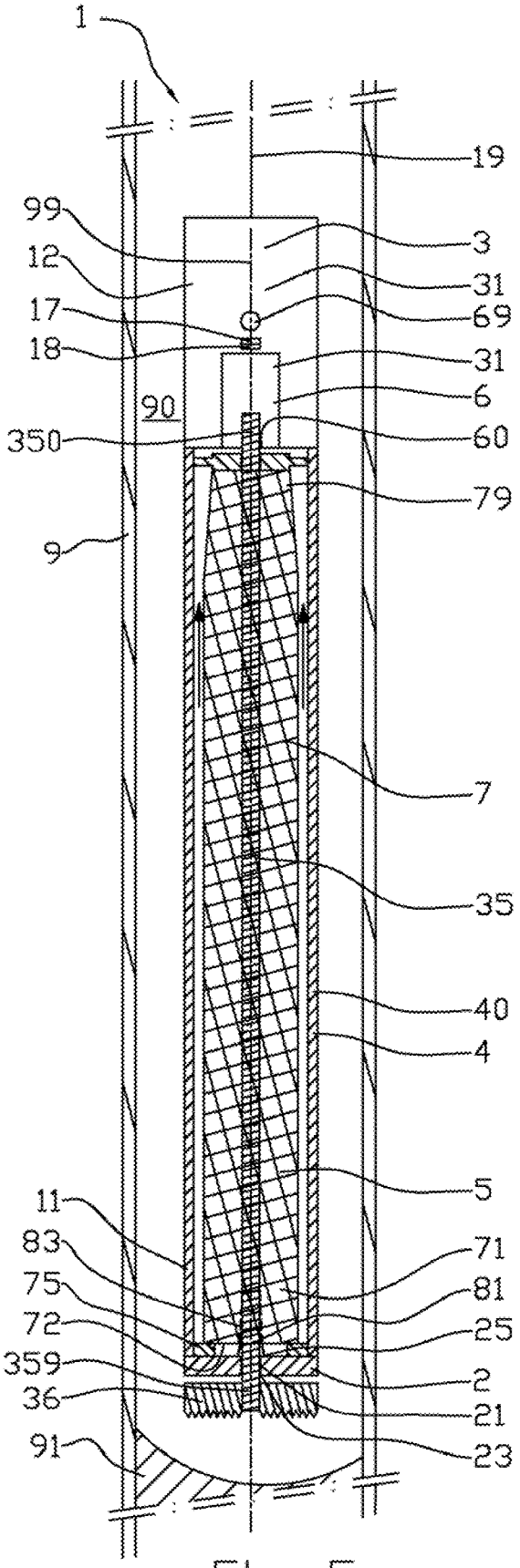
FIG. 5 shows in the same scale as FIG. 1 a collecting device according to the invention with a shaft through a collection chamber, a rotating tool at the free end of the leading portion and a support for a filter stocking.

In an alternative embodiment the internal outlet 25 is provided with a passive check valve 81 of low flow resistance as shown in FIGS. 1, 5 and 6. The check valve 81 may comprise a duck bill valve 83, but other check valves may be suitable as well.

In an alternative embodiment a conduit 8 extends inside the collecting chamber 5 from the collecting device's 1 leading portion 11 towards the end portion 12. The conduit 8 is connected to the nose 2. The internal outlet 25 opens into the conduit 8. The conduit 8 may be a pipe. The conduit 8 may be a stiff pipe. In one embodiment as shown in FIGS. 2 and 4, the conduit 8 may at its outlet be provided with a passive check valve 84 of low flow resistance. The check valve 84 may comprise a duck bill valve 85, but other check valves may be suitable as well.

The conduit 8 may at its outlet be provided with a deflector 86. The deflector 86 is fastened to the conduit 8 by a rack 87 such that the deflector 86 is positioned between the check valve 84 and the end portion 12.

The collecting device 1 may optionally be provided with a pressure sensor 17 or a flow rate sensor 18 in the flow path upstream of the outlet 69. In particular, the pressure sensor 17 and/or the flow rate sensor 18 may be positioned in the flow path at the pressure side of the pump. In an alternative embodiment each of the tubular sections 41, 42, 43 may optionally be provided with a pressure sensor 17 in an annular space 50 formed between the filter stocking 7 and the internal surface of the tubular sections 41, 42, 43, as shown in FIGS. 6 and 7.

In a further alternative embodiment, the collecting device 1 comprises a rotating drive shaft 35 through the collecting chamber 5. The drive shaft 35 is at a first end portion 350 connected to a motor, optionally with a gear (not shown) between the motor and the drive shaft 35. The motor may be the motor 31 that powers the pump 6. The drive shaft's 35 opposite second end portion 359 protrudes from the leading portion 11 and the second end 359 is connected to an external rotating tool 36 as shown in FIG. 5. The rotating tool 36 may be a scraper, a drill bit or another suitable tool able to loosen settled material 91 in a production tubing 9. Necessary bearings for the drive shaft 35 at the leading portion 11 is not shown. Such bearings are known to the skilled person. Patent document WO 03/036020 discloses suitable bearings and a suitable scraper.

The drive shaft's 35 second end 359 is guided through a check valve 81, such as a duck bill valve 83 as shown in FIG. 5. The duck bill valve 83 will seal against the surface of the drive shaft 35.

Loosened material 91 may be sucked into the collecting chamber 5 through the bore 21 along the drive shaft 35.

The nose 2 is detached from the collecting chamber 5. The collecting chamber 5 may be detached from the drive unit 3. An empty filter stocking 7 is provided by cutting a length of a tube formed filter of a desired mesh size to a desired length. One end of the tube formed filter is closed by a strap 73 or a strip 74 to form a filter stocking 7. In one embodiment the open first end portion 71 of the filter stocking 7 is fastened to the detached nose 2 by the fastener 75. The closed second end portion 79 of the filter stocking 7 is put into the collecting chamber 5 prior to assembling the connection chamber 5 with the nose 2. If needed the drive unit 3 is assembled with the collection chamber 5. The collecting unit 1 is then ready for operation.

In an alternative embodiment, the filter stocking 7 is provided as described above. The filter stocking 7 is thread over the deflector 86, the conduit 8 and thereafter fastened to the detached nose 2 by the fastener 75. The collection chamber 5, optionally with the drive unit 3 connected to the collection chamber 5, is thread over the filter stocking 7 and the conduit 8 and assembled with the nose 2. If needed the drive unit 3 is thereafter assembled with the collection chamber 5. The collecting unit 1 is then ready for operation.

In an alternative embodiment shown in FIG. 3, the pump 6 and a motor 33 is positioned at the leading portion 11. Collected material 91 passes through the pump 6 and the motor 33 before it enters the filter stocking 7 through the mouth portion 72 at the pump's 6 pressure side. A monopump is a suitable pump 6 for this purpose. The motor 33 may be a cylindrical electrical motor comprising an outer stator (not shown) and an inner rotor (not shown) which has a cylindrical passage along its length to allow passage of collected material 91. The motor 33 may be a hydraulic motor with a passage for collected material 91.

The collecting device 1 is in the embodiment shown in FIG. 3 provided with the adapter 15 between the pump 6 at the leading portion 11 and the collecting chamber 5. The collecting chamber 5 may consist of two or more tubular sections 41, 42, 43 as shown in FIGS. 6 and 7, that are joined to form the continuous collecting chamber 5. The adapter 15 may be provided with a swivel connection at both ends for fastening to the collection device 1. Thereby the collection device 1 may be split in three parts, i.e. the leading portion 11, the adapter 15 and the collection chamber with the end portion 12, without any need for turning the whole collection device 1 for assembling or de-assembling the collection device 1.

The filter stocking 7 is fixed to the adapter 15 by the fastener 75. The adapter may be provided with a passive check valve 81 of low flow resistance as shown in FIGS. 3 and 7. The check valve 81 may comprise a duck bill valve 83, but other check valves may be suitable as well.

In a further alternative embodiment shown in FIG. 4, a similar collection device 1 as shown in FIG. 3 is provided with a conduit 8 similar to the conduit shown in FIG. 2. The conduit 8 extends inside the collecting chamber 5 from the adapter 15 towards the end portion 12. The conduit 8 is connected to the adapter 15. The conduit 8 may be a pipe. The conduit 8 may be a stiff pipe. In one embodiment as shown in FIG. 4, the conduit 8 may at its outlet be provided with a passive check valve 84 of low flow resistance. The check valve 84 may comprise a duck bill valve 85, but other check valves may be suitable as well.

The collecting device 1 is structured in manner allowing the pump 6 to be started when the collecting device 1 hits or encounters the settled material 91. The pump 6 is in fluid communication with the external inlet 23 through the collecting chamber 5 and the bore 21. Thereby settled material 91 is sucked into the bore 21. The filter stocking 7 is positioned in this fluid flow.

Due to the filtering effect of the filter stocking 7, the sand and silt part and any gravel part of the material 91 is retained within the filter stocking 7, while the liquid fraction and possible suspended clay that followed the material 91 into the collecting chamber 5, passes through the filter stocking 7. In embodiments with the pump 6 at the end portion 12, as shown in FIGS. 1, 2, 5, 6 and 7, the liquid fraction flows out of the collecting chamber 5 and into the pump 6 through the inlet 60 and out to the outside 90 through the outlet 69. Due to the liquid in the collecting chamber 5 being on the suction side of the pump 6, the static pressure inside the collecting chamber 5 is lower than the ambient static pressure on the outside 90.

In embodiments with the conduit 8 at the suction side of the pump 6, the material 91 continues through the conduit 8 towards the pump 6. After passing the check valve 84, the material 91 is deflected by the deflector 86 and settles inside the filter stocking 7.

The pressure sensor 17 or the flow rate sensor 18 detects if there is a fluid flow through the collecting device 1. A diminished fluid flow or a ceased fluid flow indicates that the collecting chamber 5 is full of material 91 or that the filter stocking 7 is clogged by material 91. This is communicated to an operator (not shown) at a surface (not shown).

In an embodiment with pressure sensors 17 in the annular space 50, the pressure sensors 17 will each report a specific location pressure when the filter stocking 7 is empty and operation commence by activating the pump 6. The specific location pressure is dependent on the local flow speed of the liquid. In a deviating or horizontal well, the filter stocking 7 will start filling from the end portion 12. The pressure sensor 17 in the annular space 50 closest to the end portion 12 will be the first sensor 17 to report a decreased pressure due to the increase in flow speed around this part of the filter stocking 7. As filling of material 91 progresses in the filter stocking 7 from the end portion 12 towards the leading portion 11, the pressure sensors 17 will in a sequence towards the leading portion 11 report a pressure decrease. Thereby the operator may monitor the progress of filling the filter stocking 7 with material 91.

A further embodiment is shown in FIG. 7. In this embodiment the collecting chamber 5 is formed by several tubular sections 41, 42, 43, 44, 45, 46 as shown in FIG. 7 where six tubular sections are shown. The tubular sections 41, 42, 43, 44, 45, and 46 may in one embodiment be joined by threaded ends (not shown) as known in the art, e.g. by a threaded winder (not shown). In a second embodiment the tubular sections 41-46 may be joined by a flange connection (not shown). The collecting chamber 5 is continuous through the tubular sections 41-46. The filter stocking 7 is positioned within the tubular sections 41-43 closest to the end portion 12. The effect is that courser material will accumulate or settle in the tubular sections closest to the leading portion 11, while small particles and fines will be collected within the filter stocking 7.

In one embodiment a filter (not shown) may be positioned in the flow path between the filter stocking 7 and the inlet of the pump 6. In case the filter stocking 7 should rupture, the filter will prevent damage to the pump 6 caused by possible coarse particles, fragments, especially of metal, and parts of the filter stocking 7.

In one embodiment the collecting device 1 may be provided with a coarse filter or a strainer (not shown) in front of the external inlet 23. This will prevent that large particles enter the collecting chamber 5 and thereby choking the flow of materials. In one embodiment, a strainer 29 is positioned in the fluid flow up streams of the filter stocking 7. The strainer 29 is shown positioned between the end portion 11 and the filter stocking 7 as shown in FIG. 7. Thereby larger particles, swarf and other fragments are collected in the collecting chamber 5 up streams of the strainer 29.

When the filter stocking 7 is filled up with material 91, the collecting device 1 is retrieved to the surface for emptying. The collecting device 1 is finally retrieved to the surface when all settled material 91 has been removed from the production tubing 9 and other operations may be carried out.

At the surface the collecting device 1 is opened by detaching the nose 2 from the collecting chamber 5. The filter stocking 7 will follow the nose 2 and be drawn axially out of the collecting chamber 5 in the direction towards the leading portion 11 until the filter stocking 7 is fully released from the collecting device 1. The filter stocking 7 is thereafter detached from the nose 2 and closed at the first end portion 71 by e.g. a self-locking strip. In this manner the collecting chamber 5 is emptied of collected material 91 in a quick and clean manner. In an alternative embodiment, the filter stocking 7 is detached from the nose 2 and closed at the first end portion by e.g. a self-locking strip when the filter stocking 7 is partly displaced relative to the collecting device 1 and prior to being fully released from the collecting device 1.

In the alternative embodiments shown in FIGS. 3, 4 and 7, the collecting device 1 is opened by splitting the collecting device 15 at the adapter 15 and de-assembling the adapter 15. The filter stocking 7 will follow the adapter 15 and be drawn axially out of the collecting chamber 5 in the direction towards the leading portion 11 until the filter stocking 7 is fully released from the collecting device 1. The filter stocking 7 is thereafter detached from the adapter 15 and closed at the first end portion 71 by e.g. a self-locking strip. In this manner the collecting chamber 5 is emptied of collected material 91 in a quick and clean manner. In an alternative embodiment, the filter stocking 7 is detached from the adapter 15 and closed at the first end portion by e.g. a self-locking strip when the filter stocking 7 is partly displaced relative to the collecting device 1 and prior to being fully released from the collecting device 1.

The figures show different embodiments. The skilled person will understand that other embodiments are possible within the scope of the invention. The position of the pump 6, check valves 81, 83, adapter 15, length of the filter stocking 7, number of tubular sections 41, 42, 43, 44, 45, 46, presence of conduit 8 and other items may be combined in different ways than the shown embodiments.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. nt claims does not indicate that a combination of these measures cannot be used to advantage.

The invention claimed is:

1. Collecting device for displacement in a tubing, the collecting device is extended in shape with a longitudinal axis, the collecting device forms a leading portion with an entrance and an end portion; the collecting device comprises:

a wall extending from the leading portion to the end portion;

a collecting chamber formed inside a portion of the wall;

a filter positioned within the collecting chamber;

a motor;

a pump; and an outlet at the end portion, the filter comprises filter stocking provided with an open first end portion and a closed second end portion, the open first end portion faces the leading portion, the closed second end portion is closed by a closing device, the filter stocking forms a receptacle within the filter stocking, and the filter stocking is axially displaceable relative to the collecting chamber.

2. The collecting device according to claim 1, wherein the collecting device comprises a nose at the leading portion, and the nose is provided with a through bore.

3. The collecting device according to claim 2, wherein the filter stocking's open first end portion is connected to the nose by a fastener.

4. The collecting device according to claim 2, wherein the nose is detachable from the collecting device.

5. The collecting device according to claim 2, wherein the motor and the pump are positioned at the end portion.

6. The collecting device according to claim 1, wherein the pump is positioned at the leading portion.

7. The collecting device according to claim 6, wherein a detachable adapter is positioned between the pump and the filter stocking, and the filter stocking's open end portion is connected to the adapter by a fastener.

8. The collecting device according to claim 1, wherein a conduit extends within the collecting chamber from the filter stocking's open end portion such that the conduit forms a part of a flow path from the leading portion through the collecting chamber and out through the outlet.

9. The collecting device according to claim 8, wherein the conduit at a conduit outlet is provided with a passive check valve.

10. The collecting device according to claim 9, wherein the passive check valve comprises a duck bill valve.

11. The collecting device according to claim 8, wherein the conduit outlet is provided with a deflector between the conduit outlet and the end portion.

12. The collecting device according to claim 1, wherein the filter stocking is disposable.

13. The collecting device according to claim 1, wherein the closing device is selected from the group consisting of a strap and a self-locking strip.

14. A method for emptying a collecting device having collected debris from a well, said method comprises the steps of:

a) retrieving the collecting device to a surface;

b) opening the collecting device; and c) displacing a filter stocking axially towards a collecting device's leading portion; and wherein the collecting device extends in shape with a longitudinal axis and forms a leading portion with an entrance and an end portion and comprises:

a wall extending from the leading portion to the end portion;

a collecting chamber formed inside a portion of the wall;

a filter positioned within the collecting chamber;

a motor and a pump connected to the collecting device; and an outlet at the end portion, the filter comprises an axially displaceable filter stocking provided with an open first end portion and a closed second end portion, and the open first end portion faces the leading portion, and the filter stocking forms a receptacle.

15. A method according to claim 14, where the method further comprises the step of:

d1) detaching the filter stocking from a nose at the leading portion.

16. A method according to claim 15, where the method further comprises the steps of:

d2) opening the collecting device by splitting the collecting device at an adapter;

d3) de-assembling the adapter from the collecting device; and d4) detaching the filter stocking from the adapter.

17. A method according to claim 15 any of claims, where the method further comprises the step of:

e) closing the filter stocking's first end portion.

18. A method according to claim 14, where the method further comprises the step of:

f) displacing the filter stocking axially to fully release the filter stocking from the collecting device.

* * * * *